United States Patent [19]

McGillis

[11] 4,293,094

[45] Oct. 6, 1981

[54] SUPPLEMENTAL HEATING SYSTEM

[75] Inventor: Hugh D. McGillis, 78 Manomet St., Brockton, Mass. 02401

[73] Assignee: Hugh D. McGillis, Brockton, Mass.

[21] Appl. No.: 67,815

[22] Filed: Aug. 20, 1979

[51] Int. Cl.[3] ..... F24B 7/00

[52] U.S. Cl. ..... 237/55; 165/DIG. 2; 165/154

[58] Field of Search ..... 237/55, 54; 165/DIG. 2; 122/DIG. 1, 20 B; 126/110 R

[56] References Cited

U.S. PATENT DOCUMENTS

| | | | |
|---|---|---|---|
| 1,573,406 | 2/1926 | Lewis | 237/55 |
| 1,594,351 | 8/1926 | Butterfield | 98/59 |
| 2,468,909 | 5/1949 | Yeager et al. | 237/55 X |
| 4,079,885 | 3/1978 | Decker | 237/55 |
| 4,111,357 | 9/1978 | Mieczkowski | 165/DIG. 2 X |
| 4,158,439 | 6/1979 | Gibbs | 237/55 |
| 4,171,089 | 10/1979 | Schossow | 165/DIG. 2 X |

*Primary Examiner*—Edward G. Favors
*Assistant Examiner*—Henry A. Bennett
*Attorney, Agent, or Firm*—Cesari and McKenna

[57] ABSTRACT

A supplemental heating system for incorporation into the flue of a conventional home furnace includes an inner pipe section and a sleeve concentric with that pipe section, which sleeve has a diameter appreciably larger than that of the pipe section so as to form an annular space between the pipe section and the sleeve. Plates are provided between the pipe section and the sleeve to close off the ends of that space and a blower is arranged to discharge air through an opening in the sleeve wall into that space. Additional openings through the sleeve at locations away from the blower opening are provided to make connections to ducts leading to one or more hot air registers. The blower is arranged to operate with the furnace so that it is only turned on when the pipe section is heated whereby air discharged by the blower into the annular space is heated and conveyed through the registers to living spaces.

6 Claims, 3 Drawing Figures

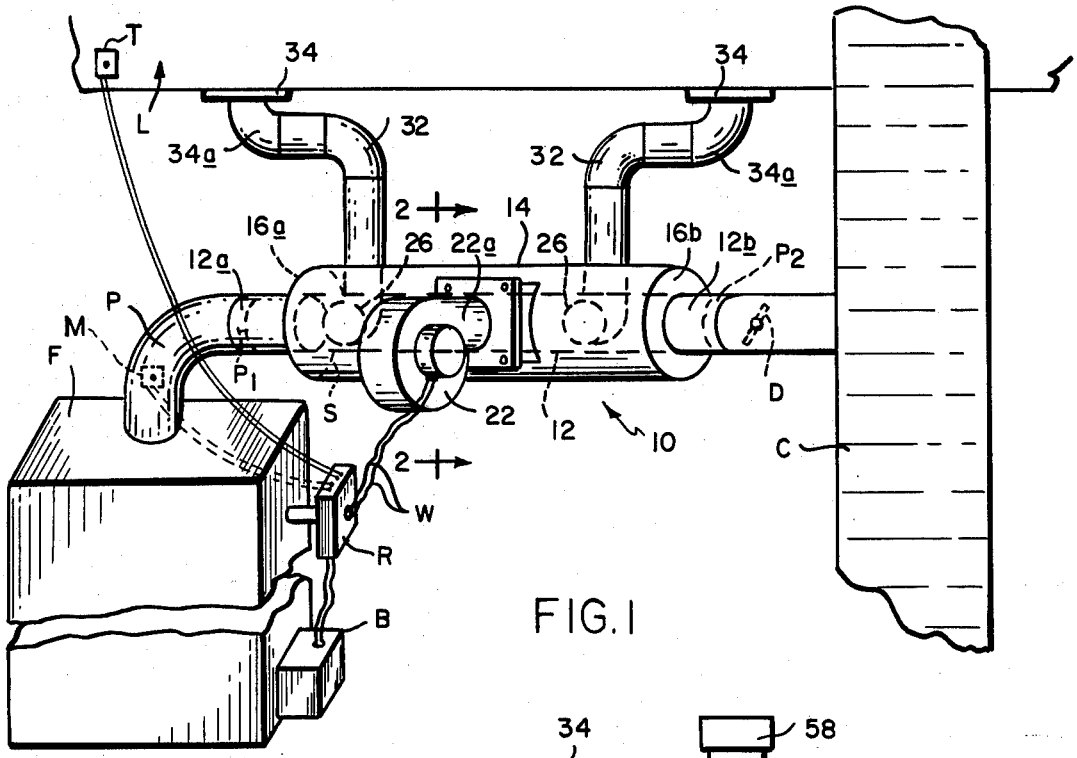
FIG. 1
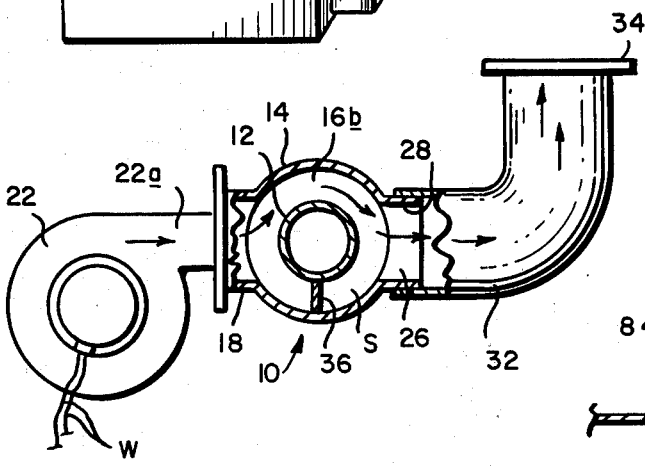
FIG. 2
FIG. 3

SUPPLEMENTAL HEATING SYSTEM

This invention relates to a warm air heater. It relates more particularly to a supplemental heating system which heats air by direct heat exchange between the air and the products of combustion exhausting from a furnace providing the primary heat for a house.

BACKGROUND OF THE INVENTION

With the ever-increasing fuel shortage, it becomes more and more necessary to find ways to conserve energy in the home. One way, of course, is through additional insulation. Another source of energy savings is to increase the efficiency of the home heating system. In the average gas or oil-fired home heating system, a considerable amount of heat generated by the burner which heats the air or water circulated throughout the house is vented through the stack or chimney to the atmosphere and is, therefore, wasted.

There have been some attempts to recapture this heat by utilizing various heat exchange structures built into the heater or flue which use the hot products of combustion to heat fresh air and releasing the heated fresh air into the living space. Examples of such structures are disclosed in the following U.S. patents:

U.S. Pat. No. 2,361,643
U.S. Pat. No. 2,385,652
U.S. Pat. No. 2,479,413
U.S. Pat. No. 2,910,276
U.S. Pat. No. 2,962,218
U.S. Pat. No. 4,138,062

While those prior structures at least appear able to produce some energy savings in the home, they have certain disadvantages which limit their use and application. Some of those conventional heat exchange devices have to be incorporated right into the heater or boiler at the time it is made. Therefore, they can't be retrofit on existing heaters in the home. Some of those prior structures are quite complicated and therefore expensive. Some others rely on counterflow of cool air in the chimney in order to operate properly. In other words, fresh air is drawn from the top of the chimney all the way down to the heater and then recirculated back up through the chimney again. This not only complicates the heat exchange system, it also requires the system to have a large, energy consuming blower to obtain the requisite air circulation. Further, the incoming cold air cools the upper end of the chimney flue pipe excessively degrading the effectiveness of the heat exchanger as a whole.

SUMMARY OF THE INVENTION

Accordingly, it is an object of the present invention to provide an improved system for recouping waste heat from a home heater.

Another object of the invention is to provide a simple heat exchange system which can be installed on existing home heaters to achieve energy savings.

Another object of the invention is to provide a heat exchange system of this type which is relatively inexpensive to manufacture and install.

A further object of the invention is to provide a system of this type whose efficiency can be optimized depending upon the heating conditions desired in the home.

Other objects will, in part, be obvious and will, in part, appear hereinafter.

The invention accordingly comprises the features of construction, combination of elements, and arrangement of parts which will be exemplified in the following detailed description, and the scope of the invention will be indicated in the claims.

In general, my supplemental heating system comprises a heat exchanger which is designed to replace a section of standard flue pipe leading from a heater to the chimney stack. The exchanger includes an inner pipe whose diameter and length are comparable to the diameter and length of the removed flue section. Surrounding the midsection of the inner pipe is a sleeve whose diameter is appreciably greater than that of the pipe so as to leave a relatively large-volume annular space between the pipe and the sleeve. The opposite ends of that space are closed off by a pair of annular plates which connect the ends of the sleeve with the pipe wall so that no gases can escape from the ends of that space. An opening is formed in the sleeve wall at one side thereof and a conventional centrifugal blower is mounted on the sleeve with its output port exhausting through that opening into the annular space in the heat exchanger. One or more additional flanged openings are formed in the sleeve at the opposite side thereof from the blower so that standard lengths of ducting can be connected to the flanges.

The heat exchanger is arranged to be mounted in the gap formerly occupied by the removed flue section. The diameter and length of the central pipe in the heat exchanger are slightly greater (or smaller) than the diameter and length of the removed flue section so that the central pipe can be telescoped onto the spaced-apart ends of the existing flue forming substantially fluid-tight joints therewith. Appropriate ducting is connected between the flanged openings in the sleeve which ducting extends up through openings in the cellar ceiling and connect to one or more hot air registers mounted in the floors or walls of the house.

The electrical leads to the blower are electrically connected to the heater relay which turns on the heater burner when the heater thermostat calls for more heat. Accordingly, each time the furnace is turned on, the hot combustion products from the burner pass up through the flue and the central pipe in the heat exchanger on their way up the chimney. At this time, the heat exchanger blower is automatically turned on so that relatively cool air is drawn from the cellar space and circulated through the annular space between the heat exchanger sleeve and central pipe. That air is heated and discharged through the ducting and floor registers into the living space.

In this fashion, the heat energy formerly wasted through the chimney is recovered and utilized to supplement the primary heat provided by the furnace. Accordingly, the living space should reach the selected temperature in a shorter time, permitting the furnace to turn off more quickly than it would otherwise do without the presence of my supplemental heating system. Of course, as soon as the furnace is turned off, the heat exchanger blower is also turned off so that cool air is not delivered to the living space through the floor registers when the heater is quiescent. Using an arrangement such as this, fuel savings on the order of 15–20% should be possible.

In another supplemental heating system embodiment, the heat exchanger is positioned right in the chimney flue leading from the furnace at the time the chimney is constructed. The heat exchanger includes an inner pipe whose lower end communicates directly with the flue pipe leading from the furnace and whose upper end extends to the top of the chimney, being topped with a standard downdraft cap. Surrounding the central pipe is a slightly larger diameter sleeve which defines with the pipe an annular space inside the chimney. The upper end of that space is closed off by an annular plate extending between the end of the sleeve and the pipe wall. The lower end of that space is closed off by a pipe leading from the output port of a blower. One or more openings are formed in the outer sleeve at locations therealong corresponding to the various levels or floors in the house and pipes or ducts connected to these openings extend through the walls of the chimney to hot air registers in the walls or floors of the house.

In this embodiment, also, the blower is connected to be turned on and off with the furnace. Here again, when the furnace is turned on and the hot products of combustion pass up the chimney through the inner pipe section of the heat exchanger, the blower draws air from the basement space or from outside the home and circulates it up through the annular space between the pipe and sleeve. That air is thereupon heated and distributed to the living space through the various registers. Preferably a free swinging damper is installed in the intake to the blower which opens when the blower is turned on, but closes when it stops so that cool air is not circulated to the living space.

This system embodiment should also achieve energy cost savings on the order of 15–20% so that its initial installation costs can be paid off in a relatively short time.

BRIEF DESCRIPTION OF THE DRAWING

For a fuller understanding of the nature and objects of the invention, reference should be had to the following detailed description, taken in connection with the accompanying drawing, in which:

FIG. 1 is a diagrammatic view of a standard home furnace incorporating a supplemental heating system made in accordance with this invention;

FIG. 2 is a sectional view along line 2—2 of FIG. 1, and

FIG. 3 is a diagrammatic view in elevation with parts in section showing another embodiment of my system.

DESCRIPTION OF THE PREFERRED EMBODIMENT

A conventional forced hot air or water or steam furnace F having an oil or gas fired burner B exhausts the hot combustion products from its combustion chamber through a flue pipe P leading to a vertical chimney or stack C to the atmosphere. A conventional damper D may be located in the flue pipe to control the back pressure in the combustion chamber. Conventionally, then, those hot products of combustion are exhausted into the atmosphere and the energy required to heat those gases is completely wasted. In accordance with this invention, however, a supplemental heating system indicated generally at 10 is installed in the flue pipe P in order to recover much of that wasted energy and deliver it as heat to a living space L in the house heated by the furnace F.

Turning now to FIGS. 1 and 2, the supplemental heating system 10 is designed to replace a section of flue pipe P between the furnace F and the damper D. The system includes an inner pipe section 12 and an outer concentric sleeve 14 which sleeve has a diameter appreciably larger than that of pipe section 12. The removed section of the flue pipe is somewhat shorter (or longer) than the length of the pipe section 12 and the pipe section has a slightly larger (or smaller) diameter so that the pipe section ends 12*a* and 12*b* can be engaged snugly or be telescoped with the spaced-apart severed ends P1 and P2 of the flue pipe.

Sleeve 14 is somewhat shorter than the pipe section 12 and annular end plates 16*a* and 16*b* are provided at the opposite ends of the sleeve, the outer rims of the end plates being welded to the sleeve ends and the inner edges of the plates being welded to the outside wall of the flue pipe so as to form an enclosed annular space S between the pipe section 12 and the sleeve 14. Formed in sleeve 14 at one side thereof is a flanged opening 18 for connecting to the discharge port 22*a* of a conventional centrifugal blower 22 so that the blower discharges its output into the space S. One or more additional openings 26 are formed in sleeve 14 at the side thereof more or less opposite opening 18. The wall of each opening 26 is provided with an outwardly extending cylindrical flange or neck 28 to which is connected a length of ducting 32 which leads to a standard hot air register 34 mounted in the floor of the living space L. Each register 34 is provided with a neck 34*a* which telescopically engages the opposte end of duct 32 to provide a fluid-tight connection from the space S through the register to the living space L.

Electrical wires W leading to the blower are connected to a standard relay unit R associated with the furnace F which relay also turns the burner B on and off in response to actuation of the thermostat T controlling the temperature of the living space L.

In operation, when the thermostat calls for heat, the relay R is closed thereby turning on burner B and also turning on the blower 22. The hot combustion products from the burner which heat the air, steam or water in the furnace providing the primary source of heat, pass up through the flue pipe P and through the supplemental heating system 10. If desired, an appropriate delay may be built into the system so that blower 22 is turned on only after the burner B is operating for a predetermined length of time. Alternatively, the blower may be turned on by a temperature sensing switch shown in dotted lines at M in FIG. 1 which senses the temperature of the flue pipe so that the blower only turns on when the flue pipe is hot. In any event, the hot gases flowing through the inner pipe section 12 heat that pipe section which, in turn, heats the fresh air forced by the blower 22 into the annular space S between that section and the outer sleeve 14.

As best seen in FIG. 2, the fresh air exhausting from the blower is brought into intimate contact with the hot pipe section 12 as shown by the arrows so that that air is heated to a considerable extent before it leaves space S and is conducted by the ducts 32 to registers 34. In order to insure adequate heating of the air, a baffle 36 can be provided between the pipe section 12 and the sleeve 14 at one side thereof as indicated in FIG. 2 so that the air tending to travel from the blower clockwise to the ducts 32 is inhibited from doing so and is redirected counterclockwise back around the top of pipe section 12 to the ducts to insure intimate heat exchange contact of the air with pipe section 12 prior to its discharge from registers 34. Also, the damper D may be adjusted to control the residence time of the hot combustion products in system 10. For maximum heating effect in system 10, the damper D should be closed a maximum amount which does not also cause combustion products and gases to back up into the furnace combustion chamber.

Accordingly, apart from the primary heat provided by the furnace F, the registers 34 can deliver a considerable amount of warm air into the living space L which otherwise would have been lost through chimney C. Consequently, the living space L will reach its selected temperature sooner than would otherwise be the case. Accordingly, the thermostat will turn off the burner B (and blower 22) sooner than would be the case in the absence of the supplemental heating system 10 so that less fuel and electricity are required to run the furnace F to maintain the selected temperature.

The heating system 10 can be installed quite easily on new heating installations. More importantly, however, it can be retrofit on existing installations so as to produce a considerable cost savings. The system itself, being composed for the most part of standard sheet metal parts, is relatively easy and inexpensive to make and it is easily installed in the flue pipe P without any special tools or equipment. Therefore, it should find wide application in the home, particularly in these days of acute energy shortage.

In some instances it may be desirable to provide a larger supplemental heating system capable of heating several living spaces on different levels in the home. A system such as this is indicated generally at 52 in FIG. 3 of the drawing. System 52 is actually incorporated into the house chimney C at the time the chimney is constructed. As is usually the case, chimney C extends up through or adjacent to several living spaces L1, L2 on different levels to the roof of the house. As with the FIG. 1 system, the system 52 is connected by way of a flue pipe P to the furnace F providing primary heat for that house.

The heating system 52 comprises an inner pipe section 54 which extends from the basement of the house to the top of the chimney C and indeed it may project somewhat above the top of the chimney. The bottom of pipe section 54 is closed off by a funnel-shaped cap 56 whose rim is welded to the lower end of section 54. The top of section 54 terminates in a downdraft cap 58.

Surrounding a major portion of section 54 is a concentric outer sleeve 62 which extends from a point below the bottom of cap 56 about three-quarters of the way along the pipe section. The diameter of the outer sleeve 62 is somewhat larger than that of pipe 54 thereby providing an annular space S between those two members. An annular plate 64 is connected between the upper end of sleeve 62 and the wall of pipe section 54. The lower end of sleeve 62 is connected to a generally L-shaped pipe 66 leading from the discharge port 68*a* of a blower 68 which receives its intake air from the interior of the cellar containing furnace F or from outside the house by way of suitable ducting 72.

A flanged opening 74 is formed near the bottom of pipe section 54 with the opening flange 74*a* projecting through a registering opening 76 formed in sleeve 62. Also a weld bead extends between flange 74*a* and the edge of opening 76 to provide a fluid-tight joint or seam all around that opening. Connected to flange 74*a* is one end of a flue pipe P whose other end is connected to receive the combustion products from the furnace F.

Also, flanged openings 82 are formed in sleeve 62 along the length of the sleeve at levels corresponding to those of the various living spaces L1, L2, etc. The opening flanges 82*a* extend out through the wall of chimney C and are terminated by hot air registers 84 opening into the living spaces.

In operation, when the furnace F is turned on by the usual thermostat demanding heat in the living spaces, the hot products of combustion pass out of the furnace via the flue pipe P up through the pipe section 54 in system 52 as indicated by the long arrows in FIG. 3. At the same time, the blower 68 is turned on so that cool air is drawn by the blower from the interior of the cellar or from outside of the house and delivered into the annular space between pipe section 54 and sleeve section 62 as indicated by the shorter arrows in FIG. 3. Alternatively, the blower 68 may be turned on by a temperature responsive switch indicated at 85 which senses the temperature of the pipe section 54 so that the blower is not turned on until the pipe is hot enough to effectively heat the fresh air delivered by the blower 68 to space S. As the air rises in the annular space S, it is brought into intimate heat exchange contact with the hot pipe section 54 and is heated so that by the time the air reaches the flanged openings 82 and is discharged via registers 84 into the living spaces L1, L2, the air is quite warm and can provide substantial supplemental heat in those spaces.

Preferably a drain pipe 86 including a trap 86*a* is connected to the funnel-shaped lower end cap 56 to drain off any moisture that might accumulate in the pipe section 54 due to condensation formed on the wall of the pipe section when it cools between furnace cyclings. Also, a free swinging damper 88 should be provided in duct 72 which conducts air into the blower 68 so that when the blower is not operating, the damper closes so that cool air is not drawn into the system and delivered through the registers 84 into the living spaces.

Thus the FIG. 3 supplemental heating system 52 utilizes the combustion gases from the furnace to heat fresh air drawn into the system. The air is recirculated directly through the system from the bottom of the chimney so that heat is recaptured and distributed throughout the living spaces quite efficiently unlike the case with prior systems of this general type which require complicated heat exchange structures and large blowers in order to effect proper heat exchange between the flue gases and the outside air. Accordingly, a system such as this yielding on the order of a 15–20% savings in heating costs in a typical year should pay for itself within a relatively short time.

It will thus be seen that the objects set forth above, among those made apparent from the preceding description, are efficiently attained, and, since certain changes may be made in the above constructions without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. A supplemental heating system for installation in a furnace flue which includes a flue pipe and a chimney, connecting the furnace to the atmosphere, said system comprising an inner pipe section, arranged to be connected in the flue, a sleeve having a diameter appreciably larger than that of the pipe section and positioned concentric therewith, closure means connected between the ends of the sleeve and the wall of the pipe section for defining with the section and the sleeve an annular space; means defining a first opening in the sleeve; a blower mounted to the sleeve, said blower having its outlet communicating with said first opening such that air can be forced into said first opening in a direction substantially normal to the wall of the sleeve; one or more additional openings in the sleeve being circumferentially positioned from said first opening; a baffle connected between the outer wall of the pipe section and the inner wall of the sleeve and being circumferentially positioned approximately midway between said first opening and said one or more additional openings in said sleeve, said baffle extending longitudinally along said pipe section and substantially abutting said closure means whereby when the system is connected in said flue pipe between the furnace and the flue and the furnace is turned on, the hot products of combustion therefrom pass through the inner pipe section thereby heating it so that when the blower is turned on, the air discharged thereby into said annular space is forced in one direction around the outer surface of the inner pipe section thereby to heat the air as it is discharged through said additional openings.

2. The system defined in claim 1 and further including one or more hot air registers, the number of which corresponds to the number of additional openings in the sleeve and duct means for conveying the heated air discharged through said additional openings to said registers.

3. The system defined in claim 1 and further including an adjustable air damper positioned in the flue between the sleeve and the chimney.

4. The system defined in claim 1 and further including an air damper for controlling air flow into the blower.

5. The system defined in claim 1 and further including a downdraft cap at the top of the pipe section.

6. The system defined in claim 1

A. wherein the inner pipe section extends below the sleeve, and

B. further including fluid drain means at the bottom of said pipe section.

* * * * *